US006568829B2

(12) United States Patent
Garrity et al.

(10) Patent No.: US 6,568,829 B2
(45) Date of Patent: May 27, 2003

(54) FLASHLIGHT

(75) Inventors: Kevin S. Garrity, Madison, CT (US); Andrew Yau, Bangkok (TH)

(73) Assignee: Garrity Industries, Inc., Madison, CT (US)

( * ) Notice: Subject to any disclaimer, the term of this patent is extended or adjusted under 35 U.S.C. 154(b) by 0 days.

(21) Appl. No.: 09/878,954

(22) Filed: Jun. 13, 2001

(65) Prior Publication Data

US 2002/0191392 A1 Dec. 19, 2002

(51) Int. Cl.[7] ..... F21L 7/00

(52) U.S. Cl. ..... 362/171; 362/190; 362/191; 362/208; 362/202; 362/116

(58) Field of Search ..... 362/116, 202, 362/208, 190, 191, 207; 320/112, 113; 429/99, 100

(56) References Cited

U.S. PATENT DOCUMENTS 5,957,567 A * 9/1999 Kish et al. ..... 362/202

* cited by examiner

*Primary Examiner*—Sandra O'Shea
*Assistant Examiner*—Anabel Ton
(74) *Attorney, Agent, or Firm*—Fitzpatrick, Cella, Harper & Scinto

(57) ABSTRACT

A portable flashlight having an elongated battery housing member that holds one or more batteries. A switch, which turns on and off a bulb, is mounted on the elongated battery housing member. A supporting member is connected to a proximal end of the elongated battery housing member and has a first bulb and a second bulb. The second bulb is mounted in a holder and a screw physically connects the holder to the supporting member, and the supporting member to the elongated battery housing. A cap member, which is mounted to the supporting member, has a reflective surface and a transparent lens.

5 Claims, 6 Drawing Sheets

FLASHLIGHT

BACKGROUND OF THE INVENTION

1. Field of the Invention

The present invention relates generally to a portable lighting apparatus. More particularly, the present invention relates to a flashlight, that has a support member between a cap and a battery housing.

2. Background Art

In the past, various types of flashlights have been used to provide a portable source of illumination. Conventional flashlights typically include a source of power, such as a battery, an electric lamp, a cylindrical casing, a switch and reflective surface.

U.S. Pat. No. 6,161,936, issued to Sato, entitled "Portable Lighting Device" relates to a flashlight device with a battery casing, a miniature lamp mounted near the end of the battery casing and a shielding plate arranged at a position separated from the miniature lamp in an axial direction of the battery casing. The shielding plate is made of a semi-transparent material and contains a light storing material.

U.S. Pat. No. 5,842,777, issued to McDermott, entitled "Flashlight" relates to a flashlight powered with an oblong power supply. The flashlight is designed to be compact and watertight and is protected against the entrance of moisture with a single O-ring seal. An ON-OFF switch uses a mechanism independent of the location of the power supply so that power supply movement will not cause inadvertent energizing of the lamp or hazardous sparks.

U.S. Pat. No. 5,586,819, issued to Bamber et al., entitled "Flashlight" relates to a modular flashlight formed from three parts that are screwed together. The three parts are a battery housing, a switch housing and a head. An O-ring at each screw connection provides a substantially watertight seal. A bulb is mounted in the switch housing and a reflector is mounted in the head. Rotation of the head relative to the switch housing varies the focus of the light reflected by the light by the reflector. The head can be removed from the switch housing so that the bulb can provide illumination.

Flashlight bulbs have a limited operational life. Once the bulb fails, the flashlight is non-operational until the bulb is replaced. Since flashlights are portable, and are carried in a user's hand, the bulbs are subject to failure, which can occur from exceeding the operational life of the bulb, or by shock to the bulb by dropping the flashlight, or other impact. When flashlights are used for camping or other outdoor activities, bulb failure can be extremely troublesome since the user may be far from a location that sells replacement bulbs.

Therefore, what is needed is a new and improved flashlight design that provides a support member between a battery housing and a cap portion.

SUMMARY OF THE INVENTION

One embodiment of the present invention is a portable flashlight apparatus that includes an elongated battery housing member that holds one or more batteries. A switch, for turning on and off a bulb, is held by the elongated battery housing member, and a supporting member is connected to a proximal end of the elongated battery housing member to provide electrical connections for the bulb.

Connection means, such as one or more screws, physically connect the supporting member to the elongated battery housing. A cap member, which is mounted to the supporting member, has a reflective surface and a transparent lens. A bulb is held in position between the supporting member and the cap.

A second embodiment of the present invention is a flashlight that includes a supporting member, which holds a first bulb and a second bulb. The first bulb is electrically connected to a power source. The second bulb is mounted in a holder and serves as a spare. A screw secures the holder to the supporting member and also secures the supporting member to a body member of the flashlight. Additional screws are used for physically connecting the supporting member to the body member. The supporting member also has one or more leg portions that add additional support for the supporting member.

DETAILED DESCRIPTION OF THE INVENTION

Figure 1:
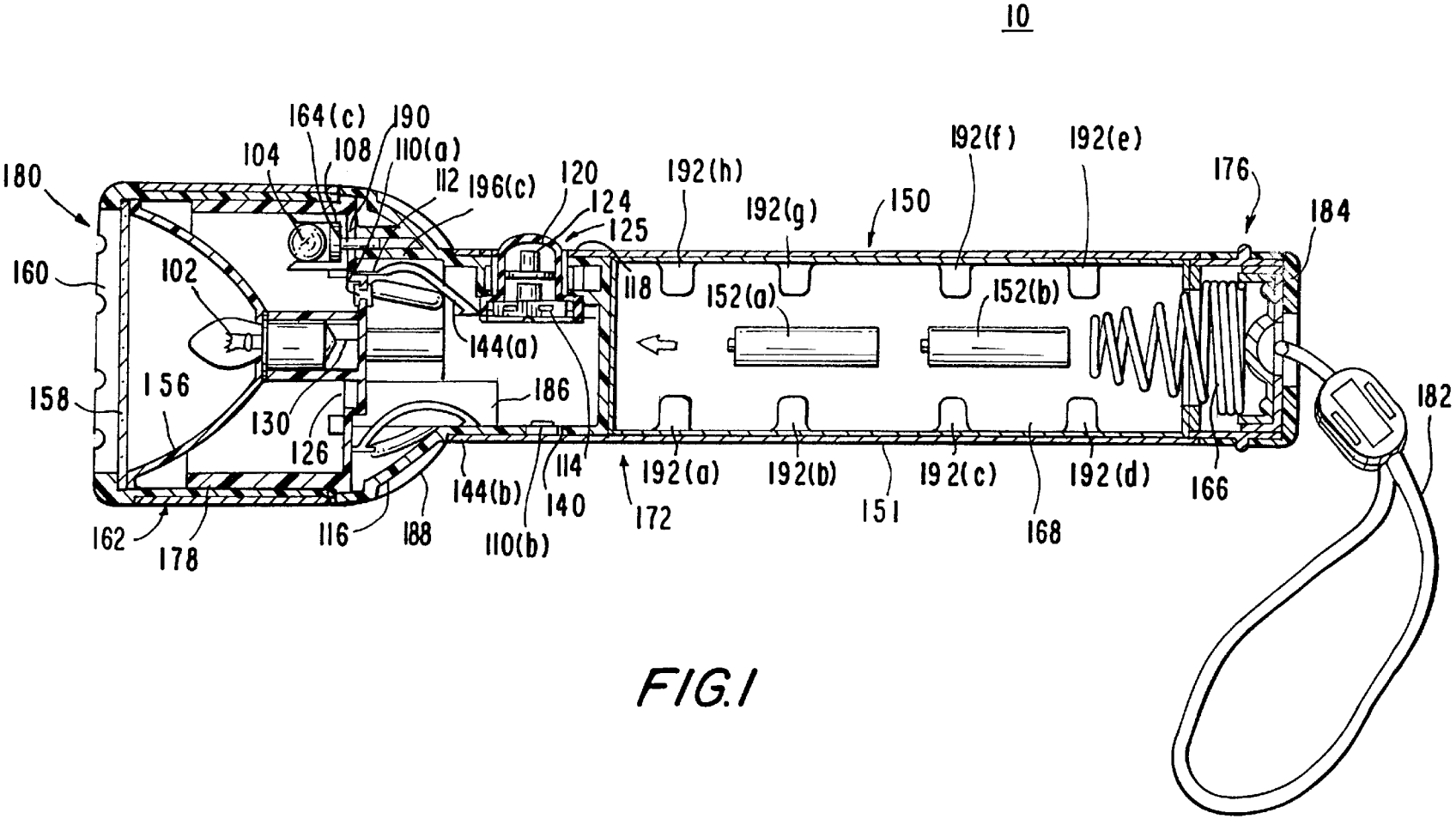
FIG. 1 shows a cutaway view of a flashlight according to the present invention.

FIG. 1 shows a cutaway view of the flashlight apparatus 10. The flashlight apparatus 10 includes a battery housing 150, a cap-portion 180 and a supporting member 162.

The battery housing 150 has cylindrical battery holder 151 having proximal portion 172 and a distal portion 176. The proximal portion 172 is in proximity to the cap 180 and the distal portion is in proximity to holding strap 182. Within the cylindrical battery holder 151 is inner battery sleeve 168, which provides a means for supporting and aligning one or more batteries 152(*a*) and 152(*b*), generally referred to as batteries 152, herein. (Although only two batteries 152(*a*) and 152(*b*) are shown in FIG. 1, in a reduced size, any suitable number of batteries may be used.) Batteries 152 are typically D size dry cells arranged end to end in electrical series. The inner battery sleeve 168 is typically manufactured from a polymer material, such as plastic.

A portion of sleeve 168 has a semi-circular surface used to cradle the batteries. Tabs 192(*a*) . . . (*h*) extend from the semicircular portion to secure batteries 152. Sleeve 168 enables a pole of one of batteries 152 to make electrical contact such that power is supplied to the bulb 102. Proximal portion 172 of the battery holder 151 is structured so as to slidably mate with a flange 188, which has a shoulder portion 116 with a substantially concave inner surface. The flange 188 has dimensions that accommodate supporting member 162. Flange 188 has columns 196(*a*), (*b*), and (*c*), as shown in the drawings, and those columns extend into the concave shoulder portion 116 to receive respective fasteners such as screws 164(*a*), (*b*) and (*c*), to secure-supporting member 162 to flange 188.

Mounted at the distal portion 176 of battery holder 151 is battery access cap 184 and holding strap 182. Battery access cap 184 typically has a camming surface, such as threads (not shown) that enables the cap to be connected to a corresponding camming surface of the distal portion 176 of battery holder 151.

Spring 166 provides pressure between batteries 152 and battery cap 184 such that batteries 152 are in contact with switch circuit 125.

Switch circuit 125 includes a switch 114, a plunger 124, a switch cover 120 and a switch ring 118. The switch circuit 125 enables a user to turn on and turn off the flashlight illumination. Wires 144(*a*) and 144(*b*) provide an electrical conduit for current from switch circuit 125 to bulb 102 and back to a spring contact 140 that bears against the inner wall of the battery holder 151 which may be conductive and electrically connected to the batteries through the battery cap 184.

The cap 180 includes a substantially concave reflective surface 156 and a lens 158, which is typically a semi-transparent or plastic material. Lens 158 is used to protect bulb 102 and reflective surface 156 from damage. Cover rim 160 is disposed adjacent to and surrounding an outer peripheral edge of the lens 158 and is used to hold lens 158 in position.

Supporting member 162 includes a primary illumination device, also referred to as a first bulb 102, a secondary illumination device, also referred to as a second bulb 104, and second bulb holder 108. Bulb support member 162 also preferably has associated with it three screws 164(*a*) . . . (*c*), although only screw 164(*c*) is visible in FIG. 1. The bulb support member 162 has associated screw holes, not shown in FIG. 1, which allow the screws 164(*a*) . . . (*c*) to fixedly attach the bulb support member 162 with flange 188 by mating with respective ones of columns 196. The supporting member 162 also includes positive contact strip 112, and negative contact strip 126. Side contact strip 140 is mounted in the flange 188. Rivet 110(*a*) provides a physical connection between the positive contact strip 112 and the supporting member 162, while rivet 110(*b*) provides a physical connection between the side contact strip 140 and an inner wall of the flange 188. Wire 144*a* is connected between contacts 112 and switch 114, and wire 144*b* is connected between contacts 126 and 140.

Bulb 102 projects through an opening in the concave surface 156 to provide illumination. Bulb 102 fits into a socket, which includes contact spring 130 to electrically connect bulb 102 to switch circuit 125, which provides current from batteries 152. The socket receives an end of bulb 102 with an interference fit that permits a user to remove the bulb 102 without the use of a tool or instrument.

Alternatively, bulb 102 can be disposed between cap 180 and merely positioned to make electrical contact, via support member 162, with switch circuit 125.

The cap portion 180 has a camming surface on an interior surface that can be cammed onto an exterior surface 178 of bulb support member 162, which is also a camming surface. Threading the camming surfaces enables the cap portion 180 to screw onto bulb support member 162.

FIG. 1 shows leg portion 186, which is an extension from bulb support member 162. When bulb support member 162 is assembled to flange 188, leg portion 186 provides additional support, for example by contacting an inner surface of flange 188. Although only one leg portion 186 is visible in the cutaway view, typically a plurality of leg portions may be used to provide additional support to the bulb support member 162.

The secondary bulb 104 is mounted in spare bulb holder 108 in an interference fit that enables a user to remove bulb 104. The spare bulb holder has an orifice (not shown) in which screw 164(*c*) mounts spare bulb holder 108, through a surface 190 of support member 162, to affix the bulb holder 108 and the support member 162 to column 196(*c*) flange 188. Thus, the spare bulb 104 is securely affixed in spare bulb holder 108, which is then connected to support member 162 and flange 188, providing additional support not only to support member 162 but also to spare bulb 104. This additional support reduces the likelihood that the spare bulb 104 will be jolted or otherwise broken during use of flashlight 10. This configuration also enables a spare bulb to be handy such that if the primary bulb 102 should burn out or break the user can simply substitute in spare bulb 104 which is removably affixed in spare bulb holder 108, without the use of tools or other instruments.

Figure 2:
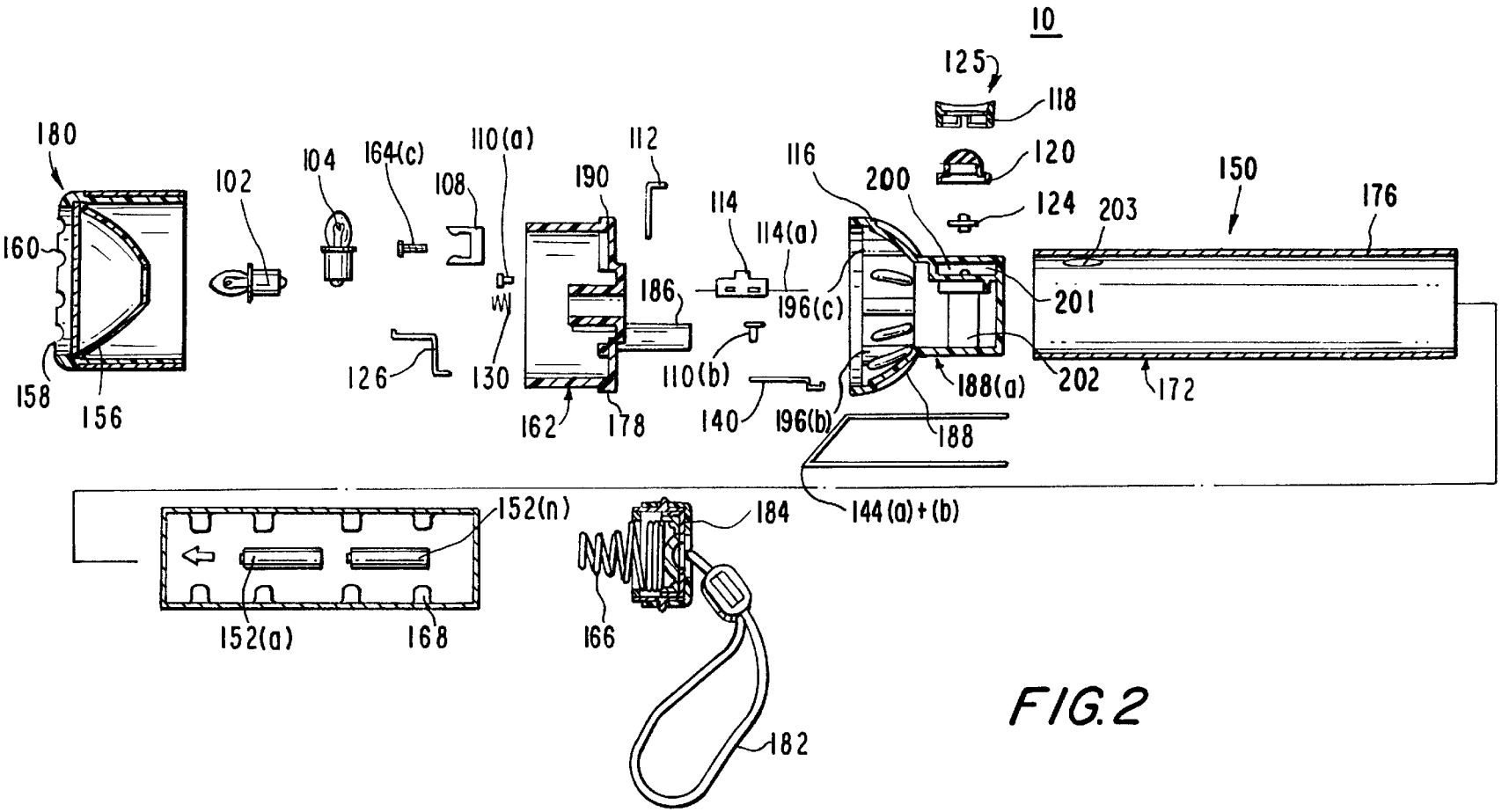
FIG. 2 shows a first expanded view of the flashlight according the present invention.

FIG. 2 shows an exploded view of the flashlight 10 described in FIG. 1. The parts have been described in relation to FIG. 1 and will not be repeated with respect to FIG. 2. FIG. 2 shows the relationship of spare bulb 104 and bulb 102. Also, as is shown in FIG. 2, the flange 188 accepts component parts 114, 118, 120 and 124 of switch circuit 125. Flange 188 comprises, in addition to the aforementioned shoulder portion 116, a cylindrical portion 188(*a*). The cylindrical portion 188(*a*) is preferably integrally formed from the same material as the shoulder portion 116. Again, the inner concave portion of the shoulder portion 116 also includes columns 196(*b*) and 196(*c*). These columns 196, together with the third column 196(*a*), which is not visible in this view, provide means for connecting support member 162 to flange 188.

In assembling the flashlight in accordance with the present invention, the cylindrical portion 188(*a*) slidably fits into an opening at the proximal portion 172 of the battery holder 151 and is secured thereto. Each of the columns 196 has an opening in its end to receive one of the fasteners 164 to provide additional strength and reduce the likelihood that cap portion 180 will separate from battery housing 150 upon impact. Although the support member 162 is shown to be fastened to the columns 196 by screws, other types of fastening means may be used instead of, or in conjunction with, screws 164. These include a snap-fit arrangement or ring devices.

As can be seen in FIG. 2, the flange 188 and switch 125 are separate components, each of which is mounted to battery holder 151. The switch components are assembled in relation to the flange 188 and battery holder 151 in such a way as to assist in securing the connection between those two elements to form the battery housing 150. In assembling the flange 188 and the holder 151 of the battery housing 150, the cylindrical portion 188(*a*) of the flange 188 is slid into the battery holder 151. The battery holder 151 is previously punched through so as to provide a hole 203 for receiving the switch ring 118. The switch ring 118 is inserted through the punched hole 203 in the battery housing 150 and ultrasonically welded to a switch ring mating chamber 200 formed within the flange 188. The ultrasonic weld advantageously strongly secures the switch ring 118 to the flange 188. A lip preferably is provided on the switch ring 118 which, when the switch ring 118 has been inserted and welded, extends around the edge of punched out hole 203 in the battery holder 151 to secure the holder to the flange 188, seal the peripheral edge of the punched out hole 203, and prevent relative movement between the flange 188, switch 125 and battery holder 151. The switch cover 120 and plunger 124 may be installed before or after the welding of the switch 118. The flange 188 includes a second chamber 201 that is formed to slidably receive the housing 114 of the switch 125, and one contact 114(*a*) of the switch is passed through a slot in the base of the sleeve 188 and bent over to contact the positive terminal of one of the batteries.

To ensure an even more secure mating between the flange 188 and the battery housing 150, two-sided tape 202 is provided at least part of the way around the cylindrical portion 188(*a*). This, in combination with the welded switch assembly 125, prevents relative movement between the battery housing 150 and the flange 188.

Figure 3:
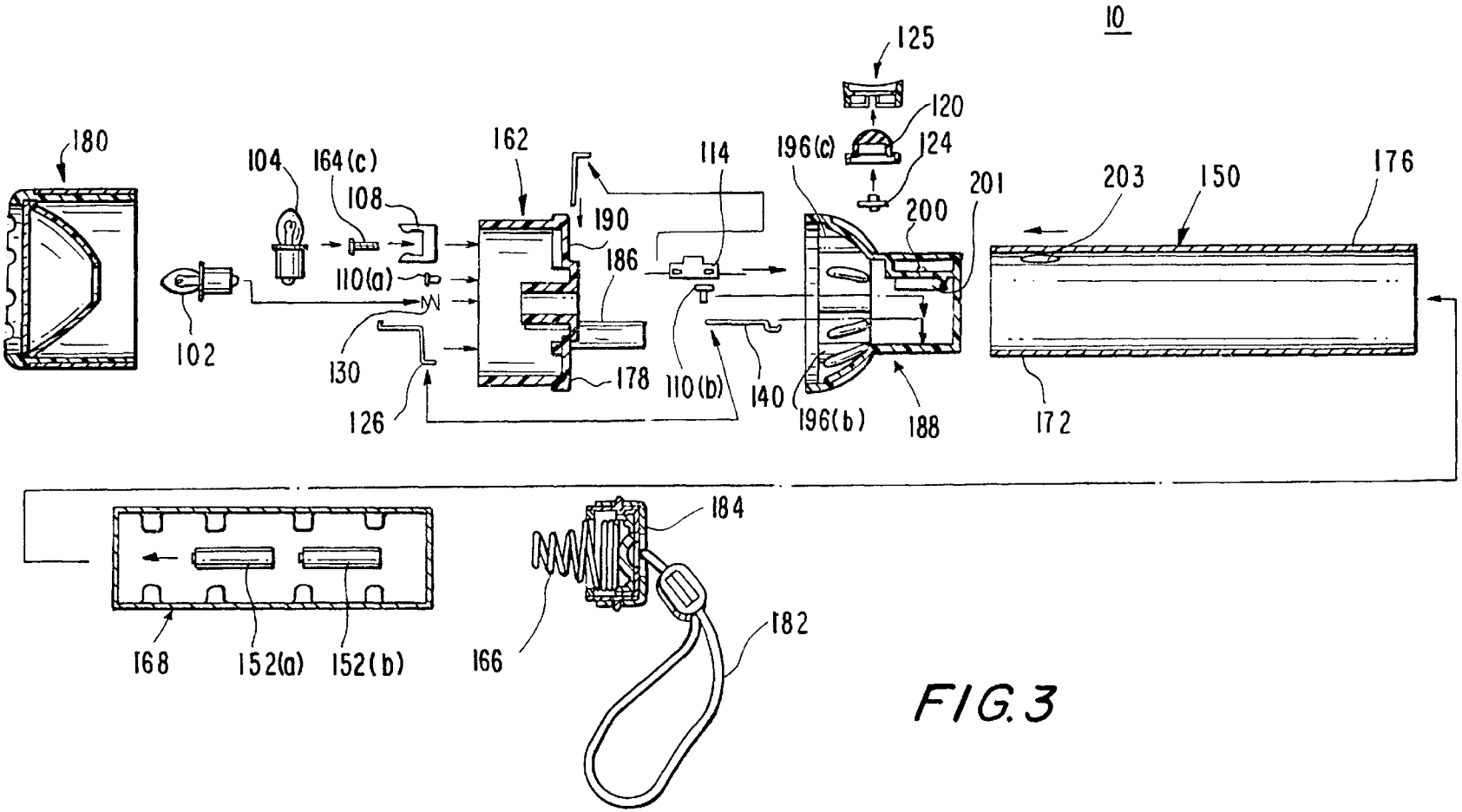
FIG. 3 shows a second expanded view of the present invention.

FIG. 3 shows an alternate embodiment of the flashlight 10 that was described in FIG. 1. As shown in FIG. 3, the wiring is rooted from the power batteries 152 to bulb 102 without going through support member 162.

Figure 4:
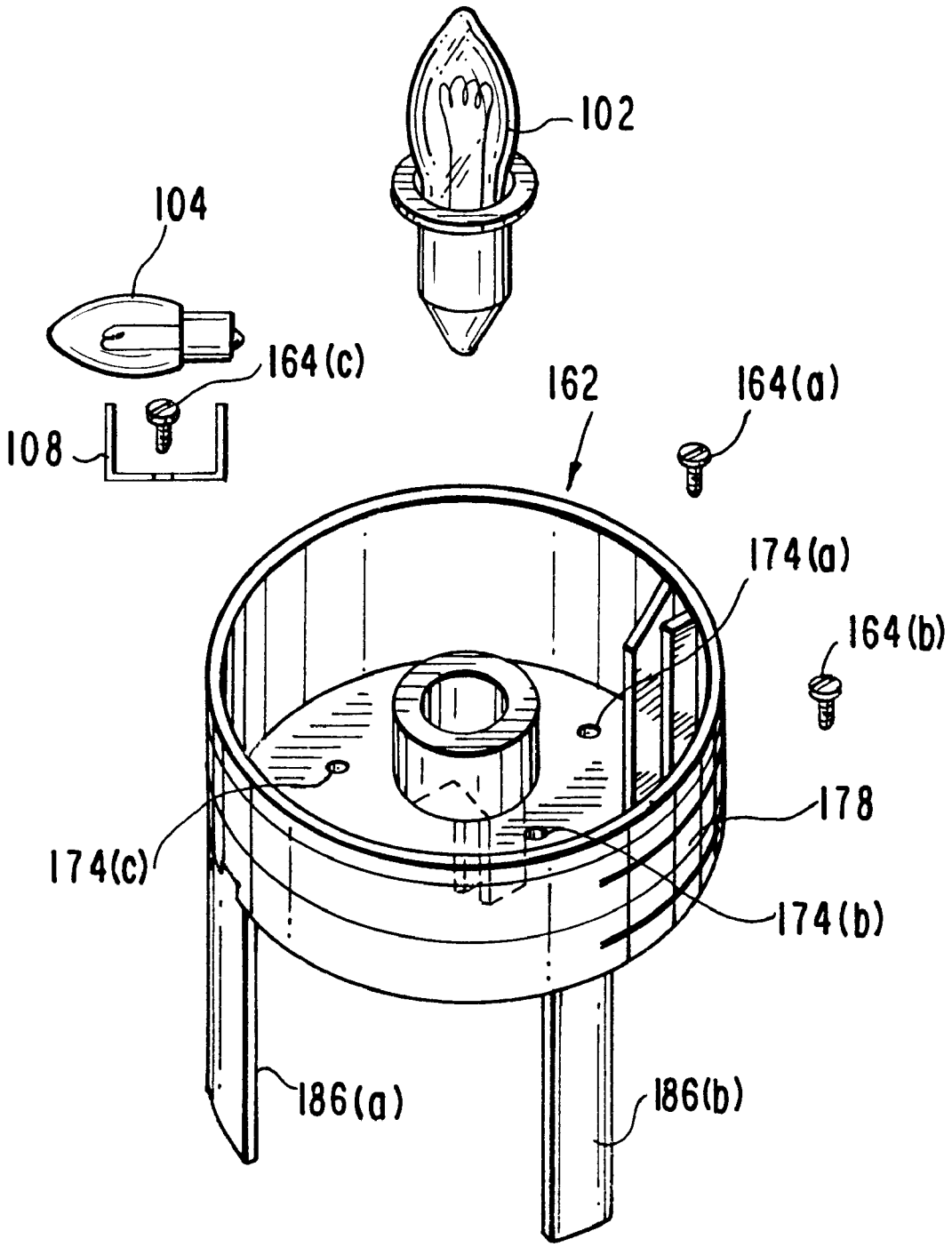
FIG. 4 shows a perspective view of a supporting member.

FIG. 4 shows a perspective view of support member 162. As seen in FIG. 4, the support member 162 has three fastener openings 174(*a*), (*b*) and (*c*). Screw 164(*c*) mounts spare bulb holder 108 and the support member 162 to threaded column 196(*c*) in the concave portion of the flange 188, which is in turn attached to the battery holder 151 to form the housing shown as element 150 in FIG. 1. Additional screws 164(*a*) and (*b*) provide additional connection means for fixedly connecting battery support member 162 to the columns 196(*a*) and 196(*b*) in the concave portion of the flange 188.

Figure 5:
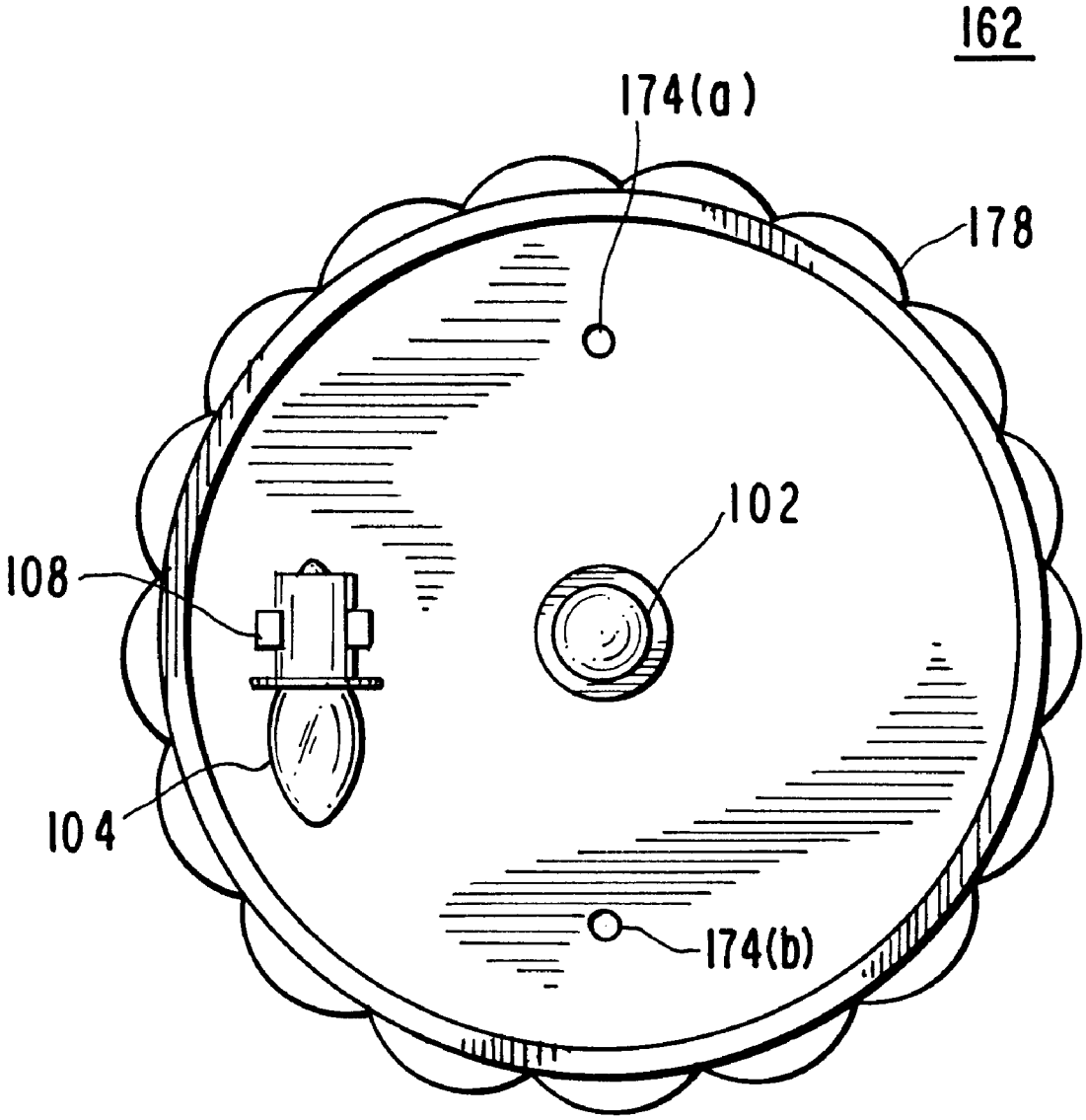
FIG. 5 shows an end view of the supporting member.

FIG. 5 shows an end view of support member 162. Corresponding screw holes 174(*a*) . . . (*c*), receive screws 164(*a*) . . . (*c*), described above. Spare bulb holder 108 holds spare bulb 104 in a position such that spare bulb 104 is not likely to be broken or otherwise damaged. Camming surface 178 on the exterior of support member 162 is also shown in this view.

Figure 6A:
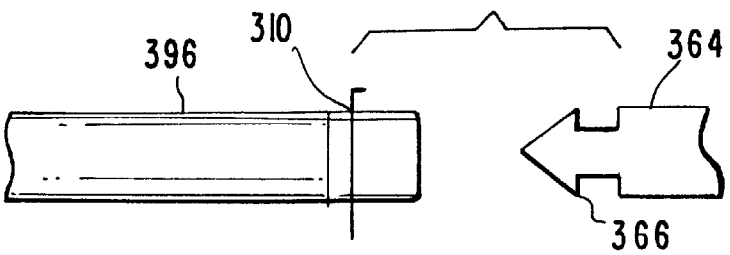
FIGS. 6A and 6B show one means of connecting a support member to a body of the flashlight.

FIG. 6A shows a column 396, which is a receiving member that receives flexible snap member 364. Column 396 may be used instead of column 196, shown in FIG. 2. Flexible snap member 364 slides into receiving member 396 and flange portion 366 expands to form a substantially interference fit with groove 370 of member 396. Flexible snap member 364 may be used instead of screws 164.

Figure 6B:
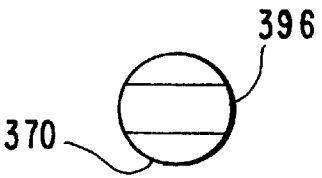

FIG. 6B shows a cross-sectional view of member 396 and groove 370.

Figure 7:
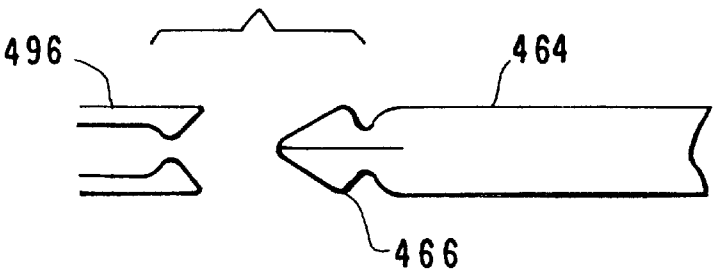
FIG. 7 shows a second means of connecting the support member to the body of the flashlight.

FIG. 7 shows another means for connecting support member (shown as element 162 in FIG. 2) to flange or battery housing (shown as elements 188 and 150 in FIG. 2). Holding member 496 may be used to hold elongated member 464 in a fixed position. Tip portion 466 interlocks with prongs of holding member 496. The holding member 496 is mounted on either the flange or the battery housing (shown above as elements 188 and 150, respectively). Elongated member 464 extends through battery support (shown as element 162, above) and secures the battery support to the flange of the battery housing.

In general, the present invention has been described above in detail by way of examples and illustrations for purposes of clarity of understanding, and not to in any way limit the scope of what is claimed. Those skilled in the art will understand that certain changes and modifications may be made to the spirit of the above without departing from the spirit of the invention.

What is claimed is:

1. A portable flashlight apparatus comprising:

an elongated battery housing adapted to hold one or more batteries, the battery housing having proximal and distal portions;

a switch circuit for providing electrical connection to the one or more batteries, including a switch mounted to the battery housing;

a cap member, the cap member having a reflective surface and a transparent lens;

a bulb having a base, the bulb having electrical connection to the switch circuit;

a supporting member adapted to engage with the cap member such that the cap member is mounted to the supporting member and the bulb is held in position between the supporting member and the cap member; and means for fixedly connecting the supporting member to the proximal end of the battery housing, including one or more fasteners and one or more columns connected to and extending within the battery housing, each column receiving one of the fasteners, wherein the bulb is turned on and off by the switch.

2. The apparatus according to claim 1, wherein the supporting member has one or more leg portions that provide additional support to the connection between the supporting member and the battery housing.

3. The apparatus according to claim 1, wherein the supporting member further comprises:

a bulb retainer mounted to the supporting member;

a spare bulb mounted in the retainer; and means for connecting the retainer to the battery housing via the supporting member.

4. A flashlight apparatus comprising:

a battery housing, adapted to hold one or more batteries;

a supporting member, adapted to hold a first bulb for electrical connection to the one or more batteries, the supporting member having one or more elongated protrusions that extend into and abut the battery housing;

one or more fasteners which fixedly connect the supporting member to the battery housing;

a switch electrically connected to the first bulb and to the one or more batteries;

a holder mounted on the supporting member, adapted to hold a spare bulb, wherein a said fastener passes through said spare bulb holder while fixedly connecting said supporting member to said battery housing and wherein the battery housing includes one or more columns mounted therein, and wherein the fasteners mate with corresponding one or more columns mounted in the battery housing.

5. The flashlight according to claim 4, wherein the fasteners include one or more screws.

* * * * *